US007455068B2

(12) United States Patent
Meissner et al.

(10) Patent No.: US 7,455,068 B2
(45) Date of Patent: Nov. 25, 2008

(54) CARBOY SUPPORT BRACKET AND METHOD OF USING SAME

(76) Inventors: Kenneth Roy Meissner, 36 Arundel Road, Winnipeg, Manitoba (CA) R2J 2K9; Kenneth Craig Harrison, 34 Arundel Road, Winnipeg, Manitoba (CA) R2J 2K9

( * ) Notice: Subject to any disclaimer, the term of this patent is extended or adjusted under 35 U.S.C. 154(b) by 487 days.

(21) Appl. No.: 10/978,693

(22) Filed: Nov. 2, 2004
(Under 37 CFR 1.47)

(65) Prior Publication Data

US 2006/0086378 A1 Apr. 27, 2006

(51) Int. Cl.
*B08B 3/02* (2006.01)

(52) U.S. Cl. ..... 134/135

(58) Field of Classification Search ..... 134/135
See application file for complete search history.

(56) References Cited

U.S. PATENT DOCUMENTS

| | | | | | |
|---|---|---|---|---|---|
| 1,357,646 | A | | 11/1920 | Miller | |
| 1,727,523 | A | | 9/1929 | Schwenk | |
| 2,128,452 | A | * | 8/1938 | Clemmons | 222/69 |
| 3,838,473 | A | * | 10/1974 | Remih | 15/105 |
| 4,104,081 | A | * | 8/1978 | Totten | 134/23 |
| 4,738,582 | A | | 4/1988 | Roberts | |
| 5,507,060 | A | | 4/1996 | Quimpo | |
| 5,560,381 | A | * | 10/1996 | Edwards | 134/176 |
| 5,816,275 | A | * | 10/1998 | Mullen | 134/141 |
| 6,009,889 | A | * | 1/2000 | Brenkus et al. | 134/22.12 |
| 2003/0047198 | A1 | * | 3/2003 | Fargnoli | 134/22.18 |

* cited by examiner

*Primary Examiner*—Frankie L Stinson
*Assistant Examiner*—Samuel A Waldbaum
(74) *Attorney, Agent, or Firm*—Adrian D. Battison; Ade & Company Inc.

(57) ABSTRACT

A carboy support bracket is disclosed for use with a basin, the basin having a peripheral wall having an upper surface defining a generally horizontal plane, the carboy support bracket comprising a frame configured for stable positioning on the upper surface of the peripheral wall, and an aperture for receiving and retaining a carboy in a generally inverted position. Heavy glass carboys used in wine and beer making by hobbyists can thereby be manipulated with ease during cleaning and drying, preventing build-up of sediment and condensation.

1 Claim, 2 Drawing Sheets

CARBOY SUPPORT BRACKET AND METHOD OF USING SAME

FIELD OF THE INVENTION

The present invention relates to container support means, and more particularly to support brackets for use in cleaning carboys.

BACKGROUND OF THE INVENTION

Wine and beer making on a non-commercial scale has gained in popularity among North American hobbyists in recent years, wherein the usual practice is to use pre-packaged ingredients to create alcoholic beverages. Various devices can be employed to achieve this end, one of the most commonly encountered components being a glass carboy. These carboys are glass containers of large volume with a small neck opening, ideal for the fermentation process involved in wine- and beer-making.

However, the small neck opening and large volume make it difficult to effectively clean the carboy interior, the result often being a sediment residue in the carboy bottom or adjacent the neck opening. This sediment can negatively affect the quality of future wine or beer products made in the carboy. Also, the size and shape of the carboy facilitates the accumulation of condensation on the interior after cleaning, and the awkward shape makes it a challenge to fully drain and dry the carboy, with the result again being a negative impact on future product quality. Finally, hobbyists are finding out what many who work With carboys have known for some time—carboys are heavy, awkward, and difficult to manipulate during attempts to use or clean them. Manipulating a heavy, wet carboy by hand during the cleaning process may result not only in sore muscles but possible carboy breakage or injury to the hobbyist due to dropping the carboy.

There have been various prior attempts to address the problems associated with carboys, such as the carboy holder disclosed in U.S. Pat. No. 1,357,646 to Miller, or the carboy loader, mover, and tilter taught in U.S. Pat. No. 1,727,523 to Schwenk. None of these, however, address the problems encountered by wine- and beer-making hobbyists during the cleaning and drying process. Numerous attempts have been made to address the problem of container cleaning and drying in the context of bottles, such as U.S. Pat. No. 4,104,081 to Totten, U.S. Pat. No. 4,738,582 to Roberts, and U.S. Pat. No. 5,507,060 to Quimpo, and the "Bottle Buddy" of Canadian Patent Application 2,216,074, but none of these provide a solution to the difficulties unique to carboys and other oversize containers.

SUMMARY OF THE INVENTION

According to a first aspect of the present invention there is provided a carboy support bracket for use with a basin, the basin having a peripheral wall having an upper surface defining a generally horizontal plane, the carboy support bracket comprising:

a frame configured for stable positioning on the upper surface of the peripheral wall; and an aperture in the frame for receiving and retaining a carboy in a generally inverted position.

According to a second aspect of the present invention there is provided a method of using a carboy support bracket to wash and dry a carboy, the carboy support bracket comprising a frame configured for stable positioning on an upper surface of a peripheral wall of a basin, and an aperture in the frame, comprising the steps of:

(a) positioning the frame on the upper surface of the peripheral wall of the basin;

(b) inverting the carboy and placing it in the aperture;

(c) rotating the carboy while washing and rinsing an interior surface of the carboy;

(d) leaving the carboy in the aperture after washing and rinsing to enable drying of the interior surface of the carboy; and (e) removing the carboy from the aperture once drying is complete.

In some exemplary embodiments of the present invention, the carboy support bracket is composed of a synthetic plastic material, preferably selected from the group consisting of polyurethane and polypropylene, and the frame comprises a frame core and four support arms connected to the frame core, the support arms arranged as two pairs extending outwardly from the frame core in opposed directions, with the aperture situated within the frame core. The support arms preferably provide clearance between the peripheral wall and the frame core to enable access to a neck of the carboy. Preferably, the frame comprises a flange circumscribing the aperture, the flange configured to retain the carboy selectively in either an inverted, generally vertical position or an inverted position at an acute angle off of vertical. The method of use disclosed herein preferably includes the step of introducing a cleaning agent within the carboy before the step of inverting the carboy, and the carboy is rotated about its long axis during washing and rinsing. It is also preferable in the method of use to have the carboy positioned in an inverted position at an acute angle off of vertical during washing and rinsing, and then positioned in a generally vertical orientation during drying.

The present invention accordingly addresses the need of hobbyists for a carboy support mechanism that is simple in both structure and operation.

A detailed description of an exemplary embodiment of the present invention is given in the following. It is to be understood, however, that the invention is not to be construed as limited to this embodiment.

BRIEF DESCRIPTION OF THE DRAWINGS

In the accompanying drawings, which illustrate an exemplary embodiment of the present invention.

DETAILED DESCRIPTION OF AN EXEMPLARY EMBODIMENT

Figure 1:
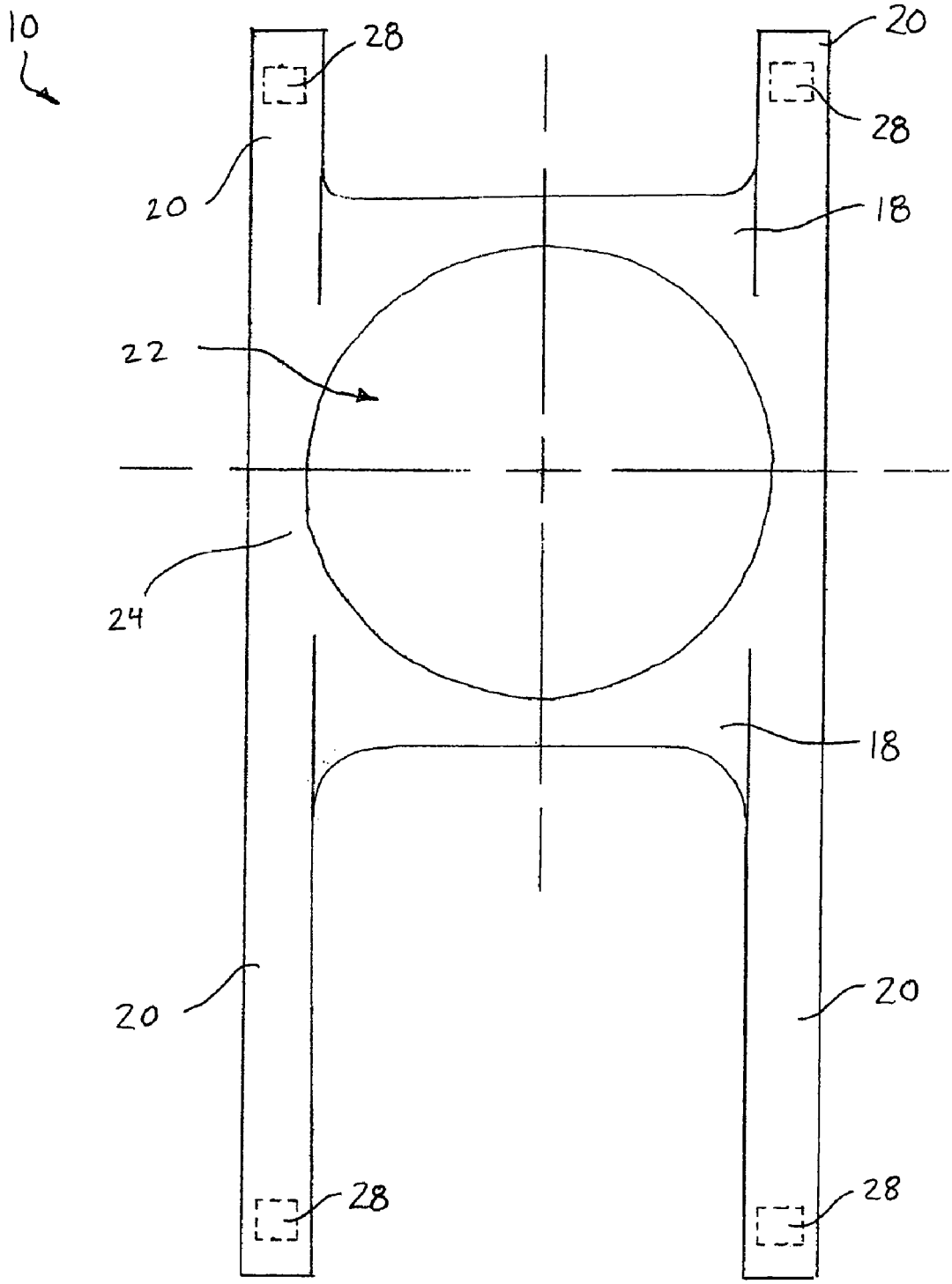
FIG. 1 is a top plan view of the carboy support bracket.

Referring now in detail to the accompanying drawings, there is illustrated an exemplary embodiment of the carboy support bracket of the present invention generally referred to by the numeral 10. As can best be seen in FIG. 1, the carboy support bracket 10 comprises a frame core 18 from which support arms 20 arranged in pairs extend outwardly in opposed directions, and an aperture 22. The aperture 22 is circumscribed by a flange 24, the angled structure of the flange 24 being illustrated in FIGS. 2 and 3 in elevation.

The carboy support bracket 10 is to be used with a basin 12, the basin 12 having a peripheral wall 14 which has an upper surface 16 defining a generally horizontal plane. The carboy support bracket 10 rests stably on this upper surface 16, but the support arms 20 are also fitted with projections 28 that abut the inner surfaces 32 of the peripheral wall 14 of the basin 12 for increased stability of the carboy support bracket 10 during use.

Figure 2:
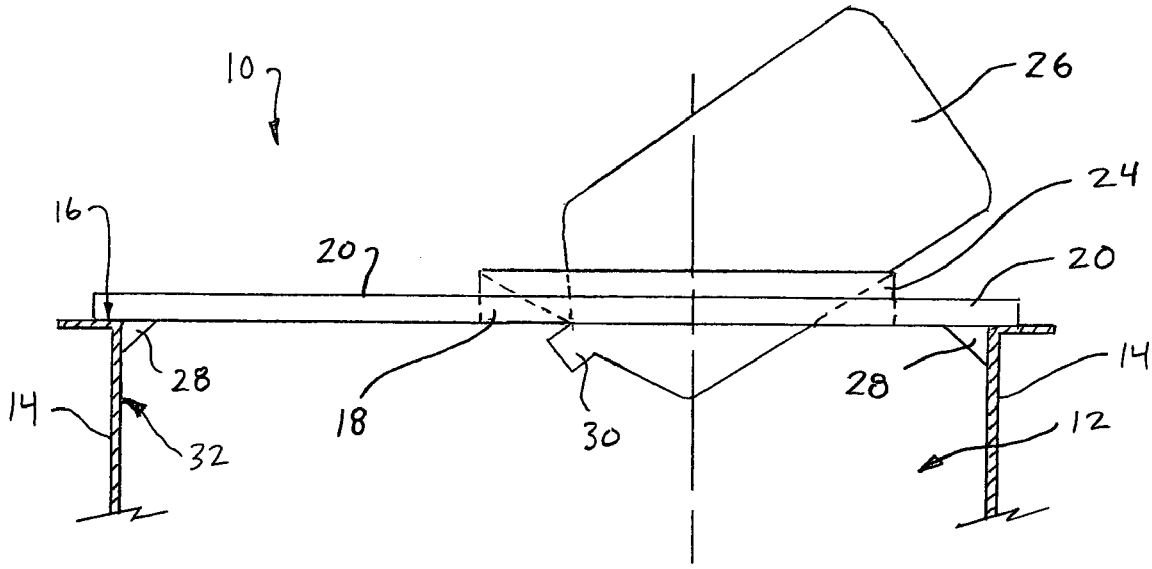
FIG. 2 is a side elevational view of the carboy support bracket with a carboy in an inverted position at an acute angle off of vertical, the peripheral wall of the basin in section.
Figure 3:
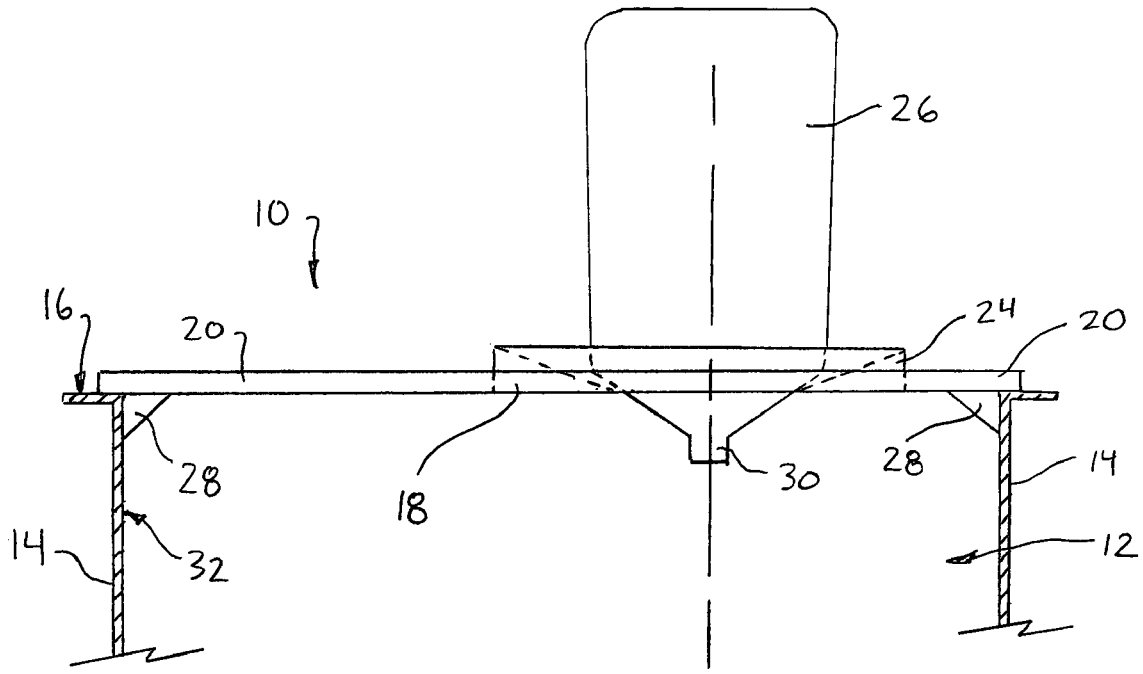
FIG. 3 is a side elevational view of the carboy support bracket with a carboy in an inverted, generally vertical position, the peripheral wall of the basin in section.

The utility of the present invention becomes clear in the following situation. After use of a carboy 26, or prior to use after a prolonged period of storage, a hobbyist (not shown) desires to clean the carboy 26 in preparation for future use. The carboy support bracket 10 is placed over top of a basin 12 in the manner illustrated in the accompanying drawings, specifically by positioning the support arms 20 on the upper surface 16 of the peripheral wall 14, and the projections 28 firmly abut the inner surfaces 32 of the peripheral wall 14. A cleaning agent (not shown) is introduced to the carboy 26, and the carboy 26 is then placed in the aperture 22 of the flange 24 in a first inverted position at an acute angle off of vertical, as is shown in FIG. 2. The carboy 26 has a neck 30, which is set against the bottom edge of the flange 24 at one side, the opposed side of the carboy 26 then resting fiat against the inclined support surface of the opposed side of the flange 24, in the manner illustrated in FIG. 2. The carboy 26 is now in a stable position for cleaning, and the support arms 20 provide clearance or space between the peripheral wall 14 and the flange 24 and between the two spaced arms 20 as shown in FIG. 1 to enable access to the neck 30. While rotating the carboy 26 about its long axis, water (not shown) can be injected into the interior of the carboy 26 and mixes with the cleaning agent. Further introduction of water can be employed to rinse out the carboy 26, again while rotating the carboy 26 about its long axis. The carboy 26 can then be inverted and positioned in a second location in which it is in a generally vertical orientation as shown in FIG. 3, to enable drying of the interior of the carboy 26. Once drying is complete, the carboy 26 can be removed from the carboy support bracket 10 and either used or stored as desired.

While a particular embodiment of the present invention has been described in the foregoing, it is to be understood that other embodiments are possible within the scope of the invention and are intended to be included herein. It will be clear to any person skilled in the art that modifications of and adjustments to this invention, not shown, are possible without departing from the spirit of the invention as demonstrated through the exemplary embodiment. The invention is therefore to be considered limited solely by the scope of the appended claims.

Embodiments of the invention in which an exclusive property or privilege is claimed are defined as follows:

1. A method of using a carboy support bracket to wash and dry a carboy, the method comprising:

providing a carboy having a neck of the carboy through which material can enter and discharge from the carboy, a peripheral side of the carboy surrounding a longitudinal axis, a base of the carboy opposite to the neck, and a shoulder portion inclined upwardly and inwardly from the side to the neck;

providing a carboy support bracket comprising a frame configured for stable positioning on an upper surface of a peripheral wall of a basin;

providing an annular flange on the frame defining a circular aperture within the annular flange with the circular aperture being defined by a circular bottom edge of the flange;

defining a support surface of the flange which is inclined upwardly and outwardly from the circular bottom edge;

providing support arms on the frame extending from the flange outwardly;

positioning the frame on an upper surface of a peripheral wall of a basin with the aperture located over the basin and the arms extending to the peripheral wall;

inverting the carboy and placing it in the aperture for washing;

locating the carboy in a first inverted position, for rotating during washing, at an angle in which the axis is off of vertical by placing the neck of the carboy against the circular bottom edge of the flange at one side of the aperture and by leaning the side of the carboy flat against the inclined support surface of the flange at an opposite side of the aperture;

providing a space between the flange and the peripheral wall of the basin and between the arms of the frame at a position adjacent the neck to enable access through the space to the neck of the carboy for cleaning of the carboy;

locating the carboy in a second inverted position, for drying, in which the axis is vertical by placing the neck of the carboy centrally within the aperture with the shoulder portion of the carboy resting against the flange; and removing the carboy from the aperture once drying is complete.

* * * * *